US005634450A

United States Patent [19]

Hara et al.

[11] Patent Number: 5,634,450

[45] Date of Patent: Jun. 3, 1997

[54] CANISTER AND EVAPORATIVE FUEL-PROCESSING SYSTEM EMPLOYING SAME

[75] Inventors: Takeshi Hara; Teruo Wakashiro; Kazumi Yamazaki; Koichi Hidano, all of Wako; Tomoyuki Kawakami, Tochigi-ken, all of Japan

[73] Assignee: Honda Giken Kogyo Kabushiki Kaisha, Tokyo, Japan

[21] Appl. No.: 661,552

[22] Filed: Jun. 11, 1996

[30] Foreign Application Priority Data

Jun. 12, 1995 [JP] Japan ..... 7-169196

[51] Int. Cl.[6] ..... F02M 25/08

[52] U.S. Cl. ..... 123/519

[58] Field of Search ..... 123/516, 518, 123/519, 520; 55/385.3, 385.4; 96/131, 132, 135, 136, 139, 141

[56] References Cited

U.S. PATENT DOCUMENTS

| | | | |
|---|---|---|---|
| 4,308,840 | 1/1982 | Hiramatsu et al. | 123/519 |
| 4,448,594 | 5/1984 | Kozawa | 123/519 |
| 4,496,379 | 1/1985 | Kozawa | 123/519 |
| 4,766,872 | 8/1988 | Kato et al. | 123/519 |

FOREIGN PATENT DOCUMENTS 1-159455 6/1989 Japan .

*Primary Examiner*—Thomas N. Moulis

*Attorney, Agent, or Firm*—Nikaido, Marmelstein, Murray & Oram LLP

[57] ABSTRACT

A canister is comprised of a casing including a top wall, a vertical wall, first and second chambers formed in the casing and each accommodating an adsorbent, and a partition member partitioning the first and second chambers from each other. A plurality of first protuberances are formed on the inner surface of the top wall at a portion thereof facing toward the first chamber, and a plurality of second protuberances on the inner surface of the vertical wall at a portion thereof facing toward the first chamber. First and second filters are mounted in the first chamber in a fashion abutting on the plurality of the first and second protuberances, respectively. A first space is defined in the top wall between the first filter and the portion of the inner surface of the top wall, and a second space is defined in the vertical wall between the second filter and the portion of the inner surface of the vertical surface and communicates with the first space. A charging port and a purging port are each formed in the top wall at a location corresponding to the first chamber and each open into the first space. An atmospheric air port is formed in the top wall at a location corresponding to the second chamber.

4 Claims, 5 Drawing Sheets

CANISTER AND EVAPORATIVE FUEL-PROCESSING SYSTEM EMPLOYING SAME

BACKGROUND OF THE INVENTION

1. Field of the Invention

This invention relates to a canister and an evaporative fuel-processing system employing the same, and more particularly to a canister and an evaporative fuel-processing system, which adsorb evaporative fuel generated in a fuel tank of an internal combustion engine for vehicles, to thereby prevent evaporative fuel from being emitted into the atmosphere.

2. Prior Art

Canisters employed in conventional evaporative fuel-processing systems for internal combustion engines (hereinafter referred to as "the engine") for vehicles include a U-shaped flow-type canister as shown in FIG. 1, which is known, for example, from Japanese Laid-Open Patent Publication (Kokai) No. 1-159455. The canister 1 includes a casing 2 in the form of a rectangular parallelepiped. The casing 2 has a top wall 3 formed integrally with a plurality of protuberances 4 formed by embossing an inner surface of the top wall 3 and extending downward from the inner surface. The casing 2 has a chamber 5 and a chamber 6 formed therein and partitioned from each other by a partition member 7. The chambers 5 and 6 communicate with each other through a space 16 defined below a lower end of the partition member 7. Filters 8, 9 are mounted in the chambers 5, 6, respectively, in a fashion abutting on respective corresponding ones of the protuberances 4. Spaces 18 and 18' are defined in the top wall 3 between the inner surface of the top wall 3 and the filter 8, and between the inner surface of the top wall 3 and the filter 9, respectively.

A punched metal member 12 is mounted in a lower portion of the casing 2 and held in spaced relation to a bottom wall 13 of the casing 2 by a coiled spring 14 which upwardly urges the punched metal member 12, as viewed in the figure, to thereby define the space 16. A filter 10 is mounted on the punched metal member 12 at a lower end of the chamber 5, and a filter 11 on the punched metal member 12 at a lower end of the chamber 6. The chamber 5 is partly defined by the filters 8 and 10, and the chamber 6 by the filters 9 and 11, respectively, and are filled with activated carbon 15 as adsorbents.

A charging port 20, a high-speed charging port 21, and a purging port 22 are formed in the top wall 3 of the casing 2, at locations corresponding to the chamber 5. The charging port 20 is connected to a fuel tank 25 through a charging passage 24, and the high-speed charging port 21 to the fuel tank 25 through a charging passage 26 with a control valve 32 arranged thereacross for opening and closing the same. During refueling, the control valve 32 opens due to increased pressure of evaporative fuel in the fuel tank 25, or the valve 32 is opened by an electronic control unit (ECU), not shown. The purging port 22 is connected to an intake system 28 of the engine through a purging passage 27. An atmospheric air port 23, which opens into the atmosphere, is formed in the top wall 3 of the casing 2, at a location corresponding to the chamber 6.

Arranged across the charging passage 24 is a two-way valve 30 which is comprised of a positive pressure valve which opens when the pressure within the 35 fuel tank 25 is higher than that within the canister 1 by a predetermined amount or more, to allow evaporative fuel within the fuel tank 25 to flow into the canister 1, and a negative pressure valve which opens when the pressure within the fuel tank 25 is lower than that within the canister 1 by a predetermined amount or more, to allow evaporative fuel to flow from the canister 1 into the fuel tank 25.

An electromagnetic valve 31 is arranged across the purging passage 27, which is controlled by the ECU to control the flow rate of evaporative fuel purged through the purging port 22 and the purging passage 27 into the intake system 28 of the engine, according to operating conditions of the engine.

During parking of a vehicle in which the engine is installed, with the engine in stoppage, or during operation of the engine, evaporative fuel generated in the fuel tank 25 is introduced through the charging passage 24 and the charging port 20 into the chamber 5 of the canister 1. Most of the evaporative fuel is adsorbed by the activated carbon 15 accommodated within the chamber 5, and then the remaining part of the evaporative fuel overflows from the chamber 5 and is introduced through the space 16 in the lower portion of the casing 2 into the chamber 6 to be adsorbed by the activated carbon 15 within the chamber 6.

During refueling, a large amount of air containing evaporative fuel is introduced from the fuel tank 25 through the charging passage 26 and the high-speed charging port 21 into the chamber 5 of the canister 1. The large amount of air introduced into the chamber 5 then flows through the space 16 into the chamber 6, wherefrom it is discharged through the atmospheric air port 23 into the atmosphere. Evaporative fuel contained in the air is adsorbed by the activated carbon 15 accommodated within the chambers 5 and 6 while the air flows through the chambers 5 and 6.

In the conventional U-shaped flow-type canister constructed as above, however, the flow rate of air containing evaporative fuel flowing into the canister 1 through the high-speed purging port 21 during refueling is about 1000 times as large as the flow rate of evaporative fuel flowing into the canister 1 through the charging port 20 during operation of the engine. Therefore, during refueling, the flow velocity of air containing evaporative fuel passing through the adsorbent in the canister 1 is high. As a result, the adsorbing efficiency of the canister 1 is much degraded. The rate of degradation is as large as approximately 50%.

SUMMARY OF THE INVENTION

It is the object of the invention to provide a canister which is capable of decreasing the flow velocity of air containing evaporative fuel when the air is introduced into the canister during refueling and hence has improved adsorbing efficiency, and an evaporative fuel-processing system employing the canister.

To attain the above object, the present invention provides a canister comprising:

a casing including a top wall having an inner surface, a vertical wall having an inner surface, first and second chambers formed in the casing and each accommodating an adsorbent, a partition member partitioning the first and second chambers from each other, a plurality of first protuberances formed on the inner surface of the top wall at a portion thereof facing toward the first chamber, and a plurality of second protuberances formed on the inner surface of the vertical wall at a portion thereof facing toward the first chamber;

a first filter mounted in the first chamber in a fashion abutting on the plurality of the first protuberances;

a first space defined in the top wall between the first filter and the portion of the inner surface of the top wall, a second filter mounted in the first chamber in a fashion abutting on the plurality of the second protuberances;

a second space defined in the vertical wall between the second filter and the portion of the inner surface of the vertical surface, the second space communicating with the first space;

a charging port formed in the top wall at a location corresponding to the first chamber and opening into the first space;

a purging port formed in the top wall at a location corresponding to the first chamber and opening into the first space; and an atmospheric air port formed in the top wall at a location corresponding to the second chamber.

Preferably, the casing exhibits a rectangular parallelepiped shape having four side walls, the first and second chambers being partitioned from each other by the partition member in a vertical direction and juxtaposed with each other, the vertical wall being one of the four side walls which faces the first chamber.

Alternatively, the casing exhibits a hollow cylindrical shape having a peripheral wall, the first and second chambers being partitioned from each other by the partition member such that the second chamber forms a hollow cylindrical chamber arranged at a diametric center of the casing and the first chamber forms an annular chamber arranged concentrically with and radially outward of the second chamber, the vertical wall forming a part of the peripheral wall which faces the first chamber.

To attain the same object, the present invention also provides an evaporative fuel-processing system for an internal combustion engine for a vehicle, the engine having a fuel tank, and an intake system, comprising:

a canister including;

a casing including a top wall having an inner surface, a vertical wall having an inner surface, first and second chambers formed in the casing and each accommodating an adsorbent, a partition member partitioning the first and second chambers from each other, a plurality of first protuberances formed on the inner surface of the top wall at a portion thereof facing toward the first chamber, and a plurality of second protuberances formed on the inner surface of the vertical wall at a portion thereof facing toward the first chamber;

a first filter mounted in the first chamber in a fashion abutting on the plurality of the first protuberances;

a first space defined in the top wall between the first filter and the portion of the inner surface of the top wall, a second filter mounted in the first chamber in a fashion abutting on the plurality of the second protuberances;

a second space defined in the vertical wall between the second filter and the portion of the inner surface of the vertical surface, the second space communicating with the first space;

a charging port formed in the top wall at a location corresponding to the first chamber and opening into the first space, the charging port connecting the first space to the fuel tank;

a purging port formed in the top wall at a location corresponding to the first chamber and opening into the first space, the purging port connecting the first space to the intake system; and an atmospheric air port formed in the top wall at a location corresponding to the second chamber.

The above and other objects, features, and advantages of the invention will be more apparent from the following detailed description taken in conjunction with the accompanying drawings.

DETAILED DESCRIPTION

The invention will now be described in detail with reference to the drawings showing embodiments thereof.

Figure 1:
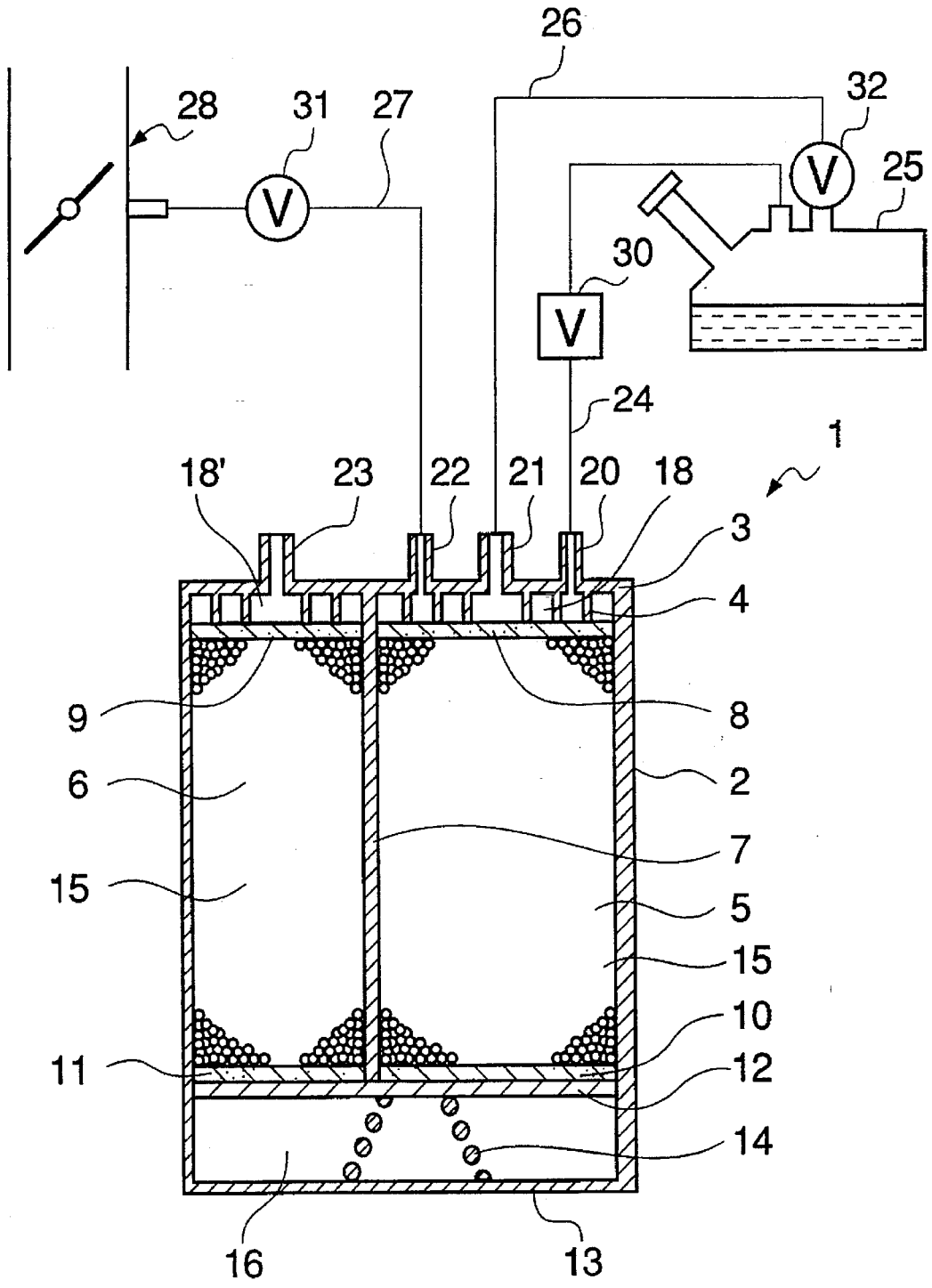
FIG.1 PRIOR ART
FIG. 1 is a schematic sectional view showing the arrangement of a conventional canister and a conventional fuel-processing system employing the same.
Figure 2:
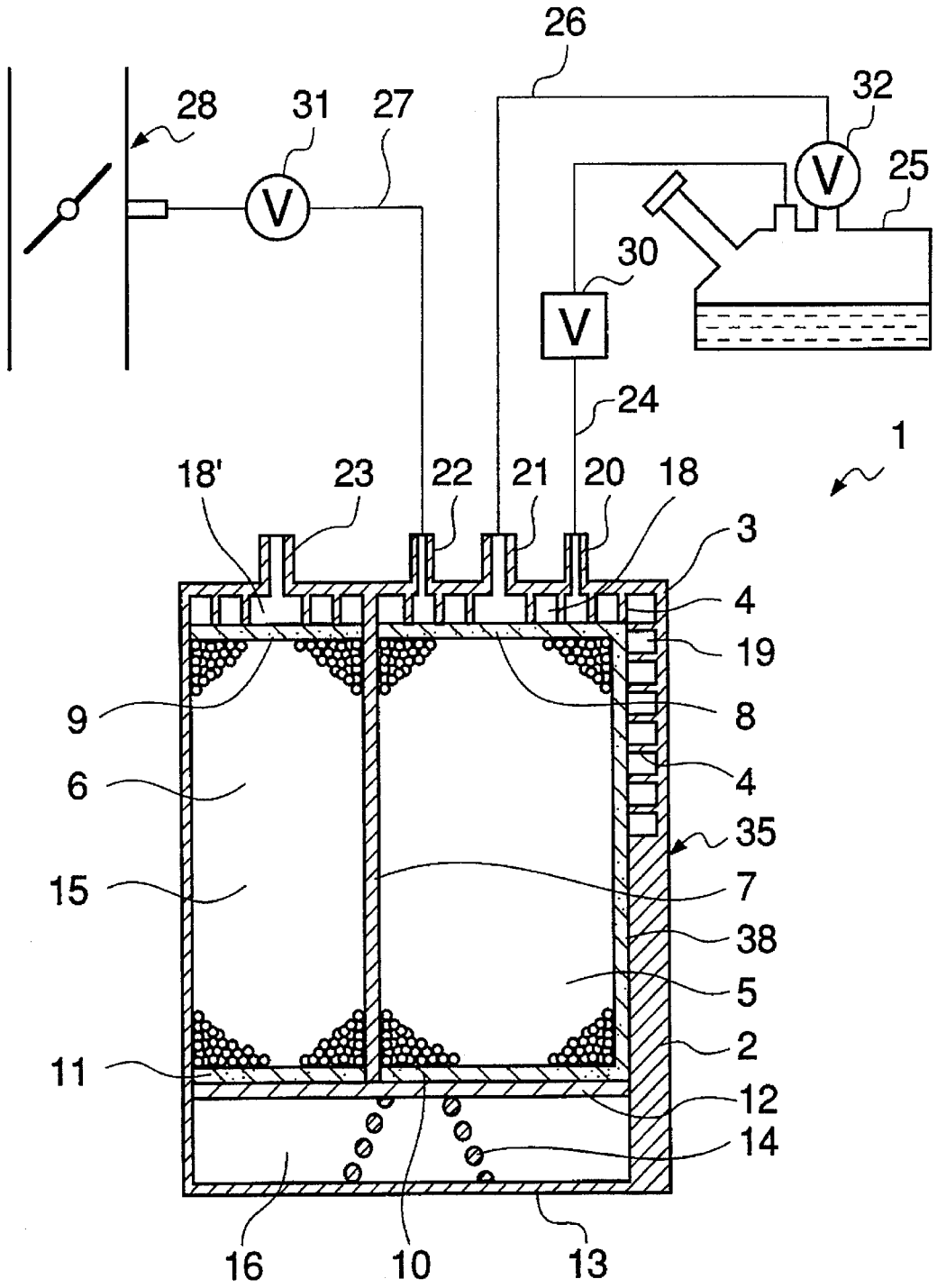
FIG. 2 is a longitudinal sectional view of a canister and an evaporative fuel-processing system employing the same, according to an embodiment of the invention.

Referring first to FIG. 2, there are schematically illustrated the construction of a canister and an evaporative fuel-processing system employing the same, according to an embodiment of the invention, the system being for use in an internal combustion engine for vehicles. Elements and parts in FIG. 2 corresponding to those in FIG. 1 are designated by identical reference numerals, description of which is omitted.

The canister according to the present embodiment is distinguished from the conventional canister of FIG. 1 in that while in the conventional canister the protuberances 4 are formed only on the inner surface of the top wall 3 of the casing 2, a plurality of protuberances 4 are formed not only on the inner surface of the top wall 3 of the casing 2 but also on the inner surface of an upper portion of a side wall 35 of the casing 2 which faces the chamber 5 via a filter 38 and is located in opposed relation to the partition member 7. The protuberances 4 are formed on the inner surface of the upper portion of the side wall 35 by embossing the inner surface and extend from the inner surface laterally inward of the casing 2o The filter 38 is additionally provided, which is mounted in the chamber 5 in a fashion abutting on the protuberances 4 formed on the inner surface of the upper portion of the side wall 35 such that it defines the chamber 5 together with the partition member 7 and the upper and lower filters 8, 10. A space 19 is defined in the upper portion of the side wall 35 between the inner surface of the upper portion of the side wall 35 and the filter 38.

Except for the above, the canister 1 according to the present embodiment is identical in construction with the conventional canister of FIG. 1.

According to the present embodiment, the spaces 18, 18' and 19 are provided not only in the top wall 3 but also in the upper portion of the side wall 35. In other words, the space area has been extended to the upper portion of the side wall 35. As a result, the passage through which air containing evaporative fuel passes has an increased area.

Figure 3:
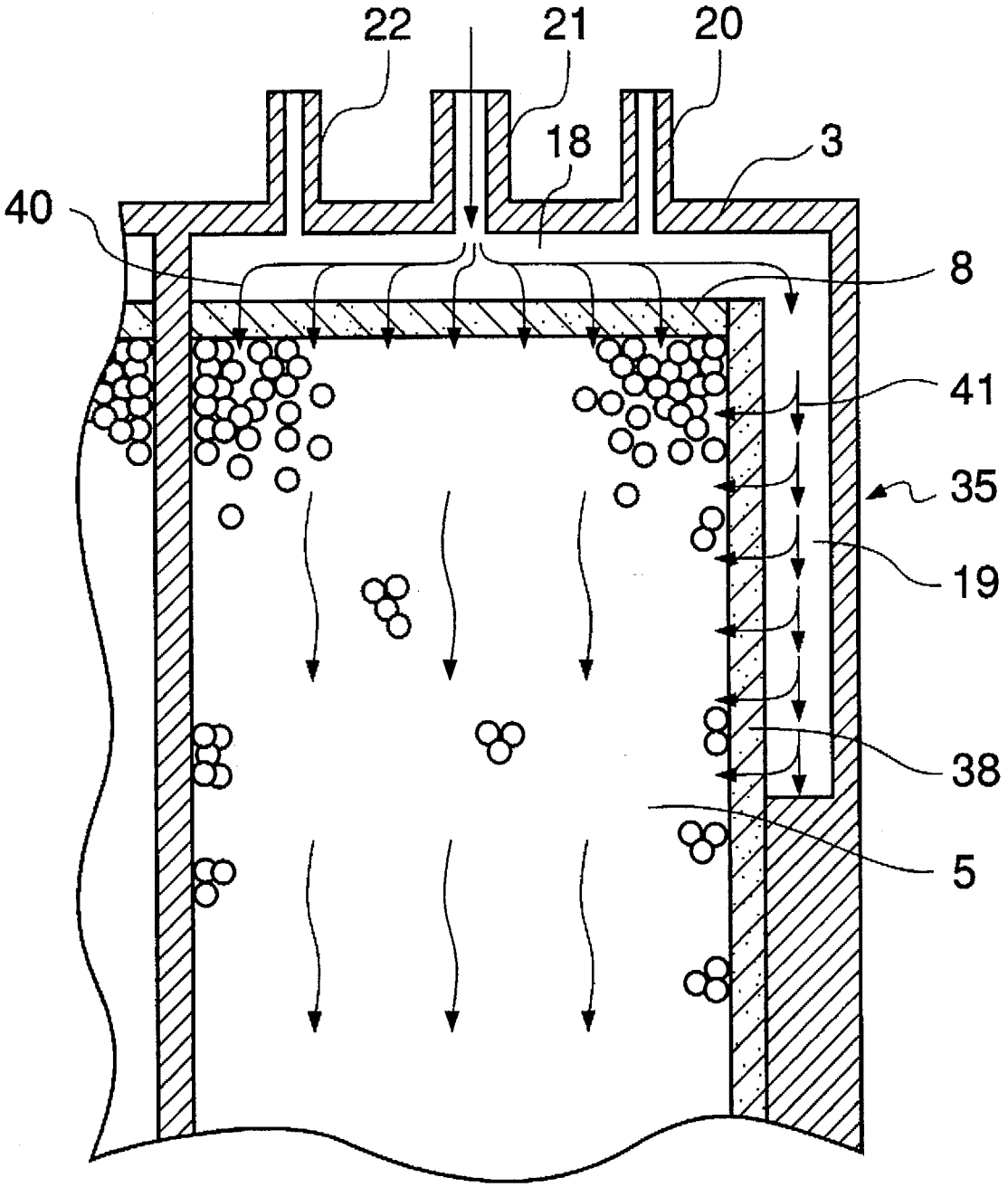
FIG. 3 is an enlarged fragmentary view of the canister shown in FIG. 2.

Next, the operation of the canister 1 according to the present embodiment constructed as above will be described with reference to FIG. 3 showing a case where evaporative fuel is processed at high speed during refueling.

As shown in FIG. 3, since the additional space 19 is provided in the side wall 35, evaporative fuel introduced into the canister 1 is divided into a flow 40 which directly flows from the space 18 into the chamber 5, and a flow 41 which once flows from the space 18 into the space 19 and then into the chamber 5. Therefore, in the chamber 5, the passage formed in the activated carbon 15, through which air containing evaporative fuel passes, has a substantially increased area so that the flow rate of evaporative fuel per unit area of the activated carbon 15 decreases. As a result, the adsorbing efficiency of the activated carbon 15 in the canister 1 is improved. The large amount of air introduced into the chamber 5 then flows through the space 16 into the chamber 6, wherefrom it is discharged through the atmospheric air port 23 into the atmosphere. Evaporative fuel contained in the air is adsorbed by the activated carbon 15 accommodated within the chambers 5 and 6 while the air flows through the chambers 5 and 6.

The operation of the present embodiment during parking of the vehicle with the engine in stoppage and during operation of the engine is substantially identical with the operation of the prior art described hereinbefore, description of which is omitted.

Figure 4:
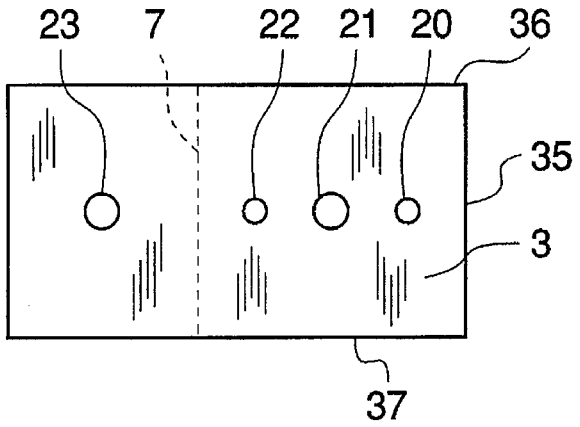
FIG. 4 is a schematic top plan view of the canister.

Although in the above described embodiment, the additional space 9 is provided in the side wall 35, a similar additional space or spaces may be provided in at least one other side wall, e.g. in at least one of side walls 36 and 37 shown in FIG. 4 which is a top plan view of the canister 1, and/or in the partition member 7.

Figure 5:
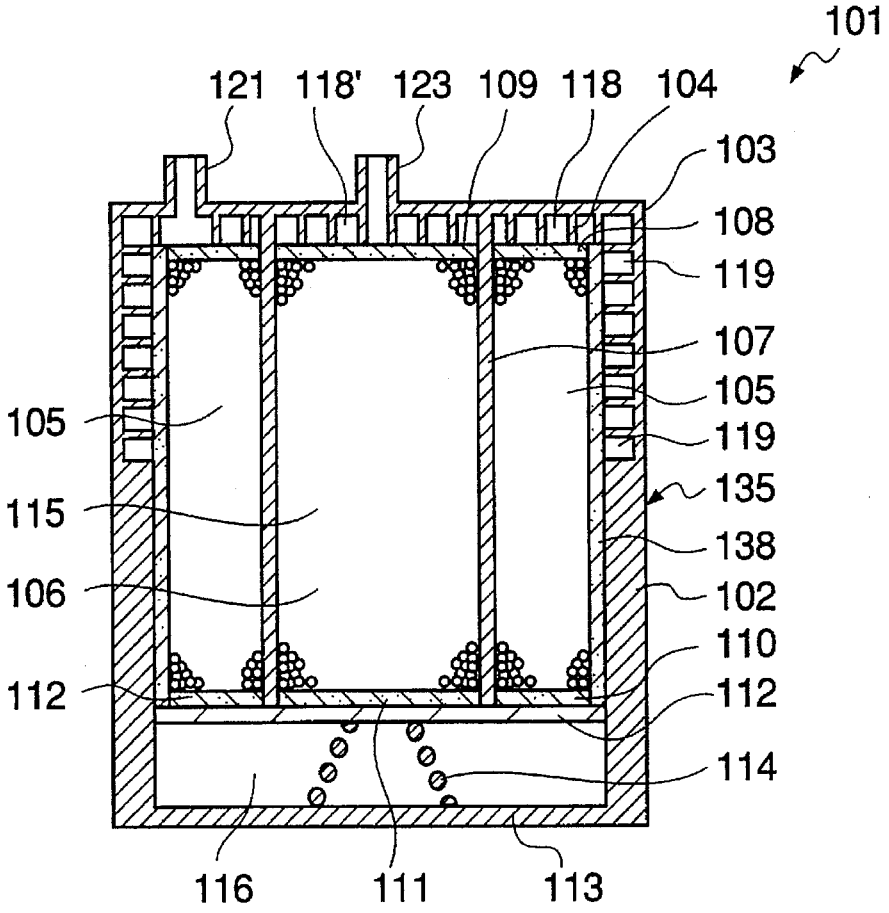
FIG. 5 is a longitudinal sectional view of a canister for an internal combustion engine, according to another embodiment of the invention.
Figure 6:
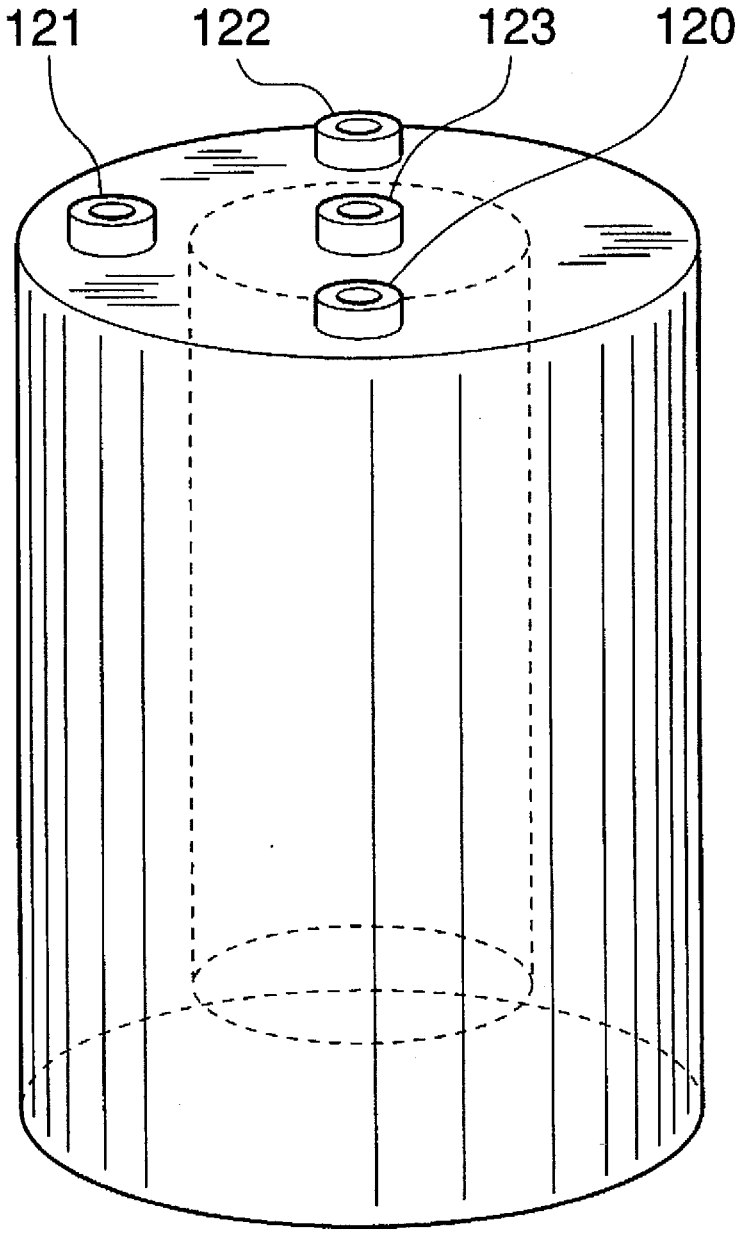
FIG. 6 is a schematic perspective view of the canister shown in FIG. 5.

Next, another embodiment of the invention will be described in detail with reference to FIGS. 5 and 6 showing the construction of a canister according to the embodiment and the outer configuration of the same, respectively.

According to the present embodiment, a canister 101 includes a cylindrical casing 102 having a top wall 103 formed integrally with a plurality of protuberances 104 extending downward from an inner surface thereof.

The casing 102 has formed therein an outer chamber 105 in the form of an annulus, and a central chamber 106 in the form of a hollow cylinder. The chambers 105 and 106 are partitioned from each other by a tubular partition member 107. The chambers 105 and 106 communicate with each other through a space 116 defined below a lower end of the partition member 107. An annular filter 108 is mounted in the chamber 105 in a fashion abutting on ones of the protuberances 104 formed on the top wall 103 and corresponding to the chamber 105, and a disk-shaped filter 109 is mounted in the chamber 106 in a fashion abutting on ones of the protuberances 104 formed on the top wall 103 and corresponding to the chamber 106. Spaces 118 and 118' are defined in the top wall 103 between the inner surface of the top wall 103 and the filter 108, and between the inner surface of the top wall 103 and the filter 109, respectively.

A punched metal member 112 is mounted in a lower portion of the casing 2 and held in spaced relation to a bottom wall 113 of the casing 102 by a coiled spring 114 which upwardly urges the punched metal member 112, as viewed in the figure, to thereby define the space 116. An annular filter 110 is mounted on the punched metal member 112 at a lower end of the chamber 105, and a disk-shaped filter 111 on the punched metal member 112 at a lower end of the chamber 106. The chamber 105 is partly defined by the filters 108 and 110, and the chamber 106 by the filters 109 and 111, respectively, and are filled with the activated carbon 15 as adsorbents.

A charging port 120, a high-speed charging port 121 and a purging port 122 are formed in the top wall 103 of the casing 102, at locations corresponding to the chamber 105. An atmospheric air port 123 is formed in the top wall 103 of the casing 102, at a location corresponding to the chamber 106. The charging port 120, the high-speed charging port 121, and the purging port 122 correspond to the charging port 20, the high-speed charging port 21 and the purging port 22 in FIGS. 2 and 3, respectively. Further, the atmospheric air port 123 corresponds to the atmospheric air port 23 in FIG. 2.

According to the present embodiment, a plurality of protuberances 104 are also formed on an inner surface of a peripheral wall 135 of the casing 102 at an upper portion thereof and over the whole circumference thereof. A tubular filter 138 is mounted in the annular chamber 105 in a fashion abutting on the protuberances 104 formed on the inner surface of the peripheral wall 135. A space 119 is defined in the peripheral wall 135 between the inner surface of the upper portion of the peripheral wall 135 and the filter 138.

Except for the above, the present embodiment is identical with the embodiment of FIG. 1 described hereinbefore in the arrangement of the evaporative fuel-processing system and the connection between component elements of the system and the ports 120–123 of the canister 101, description of which is omitted.

According to the present embodiment, the spaces 118, 118' and 119 are provided not only in the top wall 103 but also in the upper portion of the peripheral wall 135, to thereby increase the space area. By virtue of the increased space area, the passage formed in the activated carbon 115, through which air containing evaporative fuel passes, has a substantially increased area so that the flow rate of evaporative fuel per unit area of the activated carbon 115 decreases. As a result, the adsorbing efficiency of the activated carbon 115 in the canister 101 is improved.

What is claimed is:

1. A canister comprising:

a casing including a top wall having an inner surface, a vertical wall having an inner surface, first and second chambers formed in said casing and each accommodating an adsorbent, a partition member partitioning said first and second chambers from each other, a plurality of first protuberances formed on said inner surface of said top wall at a portion thereof facing toward said first chamber, and a plurality of second protuberances formed on said inner surface of said vertical wall at a portion thereof facing toward said first chamber;

a first filter mounted in said first chamber in a fashion abutting on said plurality of said first protuberances;

a first space defined in said top wall between said first filter and said portion of said inner surface of said top wall, a second filter mounted in said first chamber in a fashion abutting on said plurality of said second protuberances;

a second space defined in said vertical wall between said second filter and said portion of said inner surface of said vertical surface, said second space communicating with said first space;

a charging port formed in said top wall at a location corresponding to said first chamber and opening into said first space;

a purging port formed in said top wall at a location corresponding to said first chamber and opening into said first space; and an atmospheric air port formed in said top wall at a location corresponding to said second chamber.

2. A canister as claimed in claim 1, wherein said casing exhibits a rectangular parallelepiped shape having four side walls, said first and second chambers being partitioned from each other by said partition member in a vertical direction and juxtaposed with each other, said vertical wall being one of said four side walls which faces said first chamber.

3. A canister as claimed in claim 1, wherein said casing exhibits a hollow cylindrical shape having a peripheral wall, said first and second chambers being partitioned from each other by said partition member such that said second chamber forms a hollow cylindrical chamber arranged at a diametric center of said casing and said first chamber forms an annular chamber arranged concentrically with and radially outward of said second chamber, said vertical wall forming a part of said peripheral wall which faces said first chamber.

4. An evaporative fuel-processing system for an internal combustion engine for a vehicle, said engine having a fuel tank, and an intake system, comprising:

a canister including;

a casing including a top wall having an inner surface, a vertical wall having an inner surface, first and second chambers formed in said casing and each accommodating an adsorbent, a partition member partitioning said first and second chambers from each other, a plurality of first protuberances formed on said inner surface of said top wall at a portion thereof facing toward said first chamber, and a plurality of second protuberances formed on said inner surface of said vertical wall at a portion thereof facing toward said first chamber;

a first filter mounted in said first chamber in a fashion abutting on said plurality of said first protuberances;

a first space defined in said top wall between said first filter and said portion of said inner surface of said top wall, a second filter mounted in said first chamber in a fashion abutting on said plurality of said second protuberances;

a second space defined in said vertical wall between said second filter and said portion of said inner surface of said vertical surface, said second space communicating with said first space;

a charging port formed in said top wall at a location corresponding to said first chamber and opening into said first space, said charging port connecting said first space to said fuel tank;

a purging port formed in said top wall at a location corresponding to said first chamber and opening into said first space, said purging port connecting said first space to said intake system; and an atmospheric air port formed in said top wall at a location corresponding to said second chamber.

* * * * *